US008787116B2

(12) United States Patent
Petruzzello et al.

(10) Patent No.: US 8,787,116 B2
(45) Date of Patent: Jul. 22, 2014

(54) COLLAPSED MODE OPERABLE CMUT INCLUDING CONTOURED SUBSTRATE

(75) Inventors: John Petruzzello, Carmel, NY (US); John Douglas Fraser, Woodinville, WA (US); Shiwei Zhou, Yorktown Heights, NY (US); Benoit Dufort, Stoneham, MA (US); Theodore James Letavic, Putnam Valley, NY (US)

(73) Assignee: Koninklijke Philips N.V., Eindhoven (NL)

( * ) Notice: Subject to any disclaimer, the term of this patent is extended or adjusted under 35 U.S.C. 154(b) by 1057 days.

(21) Appl. No.: 12/747,249

(22) PCT Filed: Dec. 12, 2008

(86) PCT No.: PCT/IB2008/055279

§ 371 (c)(1),
(2), (4) Date: Oct. 4, 2010

(87) PCT Pub. No.: WO2009/077961

PCT Pub. Date: Jun. 25, 2009

(65) Prior Publication Data

US 2011/0040189 A1 Feb. 17, 2011

Related U.S. Application Data

(60) Provisional application No. 61/013,716, filed on Dec. 14, 2007.

(51) Int. Cl.
*H04R 19/00* (2006.01)

(52) U.S. Cl.
USPC ..... 367/181

(58) Field of Classification Search
USPC ..... 367/141–190
See application file for complete search history.

(56) References Cited

U.S. PATENT DOCUMENTS 7,489,593 B2 * 2/2009 Nguyen-Dinh et al. ..... 367/181
2005/0228285 A1 10/2005 Huang et al.

(Continued)

FOREIGN PATENT DOCUMENTS

JP 2005321257 * 11/2005 ..... H01L 29/84
JP 2005321257 A 11/2005
WO 2006031726 3/2006

OTHER PUBLICATIONS

Translation of JP2005321257.*

(Continued)

*Primary Examiner* — Luke Ratcliffe

(57) ABSTRACT

A capacitive ultrasound transducer capable of operation in collapsed mode either with a reduced bias voltage, or with no bias voltage, is provided. The transducer includes a substrate that is contoured so that a middle region of the flexible membrane is collapsed against the substrate in the absence of a bias voltage. A non-collapsible gap may exists between the substrate and peripheral regions of the flexible membrane. The contour of the substrate may be such as to strain the flexible membrane past the point of collapse, or to mechanically interfere with the flexible membrane. The substrate may include a further membrane disposed beneath the flexible membrane, the further membrane being contoured so that the flexible membrane is collapsed against it. The substrate may a support disposed beneath the further membrane to deflect a corresponding portion of the further membrane upward toward the flexible membrane. The support may be a post. The transducer may be operated in collapse mode with an improved efficiency ($k^2_{eff}$) as compared to otherwise similar conventional transducers exhibiting comparably uncontoured substrates. A related medical imaging system is provided, which may include an array of such transducers disposed on a common substrate. A method of operating such a transducer is provided that includes operating the transducer in the collapse mode in the absence of a bias voltage.

17 Claims, 7 Drawing Sheets

(56) References Cited

U.S. PATENT DOCUMENTS

| | | | | |
|---|---|---|---|---|
| 2006/0004289 | A1 | 1/2006 | Tian et al. | |
| 2006/0279174 | A1 | 12/2006 | Oliver et al. | |
| 2007/0140515 | A1* | 6/2007 | Oliver | 381/174 |

OTHER PUBLICATIONS

Bryram, B., et al., "A New Regime for Operating Capacitive Micromachined Ultrasound Transducers," IEEE Trans UFFC, vol. 50, No. 9 (2003), 1184-1190.

* cited by examiner

COLLAPSED MODE OPERABLE CMUT INCLUDING CONTOURED SUBSTRATE

The present disclosure is directed to systems and methods for generating medical diagnostic images and, more particularly, to ultrasonic transducers.

As discussed in Bayram, B. et al., A New Regime for Operating Capacitive Micromachined Ultrasonic Transducers, IEEE Trans UFFC, Vol. 50, No. 9 (2003), for a conventional capacitive micromachined ultrasonic transducer (cMUT) to be operated in collapsed mode, the flexible membrane of the cMUT is typically excited with a voltage that causes part of the membrane to collapse onto the corresponding cMUT substrate. Subsequent reduction of the voltage applied to the membrane to a certain threshold voltage, commonly characterized as the cMUT's 'snapback voltage', will typically cause the membrane to lift upward from the substrate, and to return to an equilibrium position. By contrast, to the extent the voltage applied to a previously collapsed membrane is kept above the snapback voltage, a fairly linear and efficient output of the device typically can be achieved.

A conventional cMUT structure is shown in FIG. 1. More particularly, FIG. 1 shows a cMUT 100 in schematic cross section including a substrate 102 in which a pocket 104 is formed, and a flexible membrane 106 mounted to the substrate 102 across the pocket 104. In circumstances in which the bias voltage applied across the flexible membrane 106 and the substrate 102 is set at a relatively low voltage, or at zero volts, the cMUT 100 will typically exhibit a gap 108 within the pocket 104 between the flexible membrane 106 and the substrate 102.

Referring now to FIG. 2, in operation, upon a voltage bias applied across the flexible membrane 106 and the substrate 102 being increased a sufficient amount from the relatively low or zero level associated with the configuration of the cMUT 100 shown in FIG. 1, the flexible membrane 106 will tend to collapse downward into the pocket 104 and toward the substrate 102. Such collapse of the flexible membrane 106 can substantially eliminate the gap 108 (FIG. 1) between the flexible membrane 106 and the substrate 102, such that a downward-facing surface 200 of the flexible membrane 106 is at least temporarily placed in physical contact with a corresponding upward-facing surface 202 of the substrate 102. This collapsed condition of the flexible membrane 106 with respect the substrate 102, once achieved, may be maintained by the continuous application across the flexible membrane 106 and the substrate 102 of a bias voltage in excess of a certain minimum level, commonly referred to as the 'snapback' voltage.

The cMUT 100 may be used in the collapsed mode to emit or receive a pressure wave. For the cMUT 100 to emit a pressure wave with the flexible membrane 106 collapsed against the substrate 102, the voltage applied across the flexible membrane 106 and the substrate 102 may be cycled between a relatively high voltage and a relatively low voltage. Both such voltages are typically higher in terms of their respective magnitudes than the snapback voltage associated with the cMUT 100. Of the relatively high voltage and the relatively low voltage, the relatively high voltage is associated with a correspondingly greater area of contact between the downward-facing surface 200 of the flexible membrane 106 and the upward-facing surface 202 of the substrate 102. As the flexible membrane 106 is induced, driven, or otherwise caused by the cycling bias voltage to alternate between such greater and smaller areas of physical contact with the substrate 102, certain portions of the flexible membrane 106 transition into and out of the area of contact with the substrate 102 (e.g., into and out of the 'collapsed region' of the flexible membrane 106) by reciprocating vertically with respect to corresponding portions of the substrate 102 within the pocket 104. Such reciprocal vertical motion of such transitional portions of the flexible membrane 106 produces the desired pressure wave. As recognized by those of ordinary skill in the art, such a cMUT 100 is typically also usable in the collapsed mode shown in FIG. 2 to generate and transmit a corresponding electrical signal in response to the flexible membrane 106 being exposed to an externally-generated pressure wave received by the cMUT 100.

In accordance with at least one common measure of the efficiency of cMUTs such as the cMUT 100 of FIGS. 1 and 2, the size or area value of that portion of the flexible membrane 106 which substantially actively participates in the emission of a pressure wave (e.g., as an output, in response to an electrical input), and/or in the receipt of and response to an incoming pressure wave (e.g., as an input, as part of a process of generating an electrical output), provides at least one basis for comparison. For example, in the case of two at least somewhat differently configured variations of the cMUT 100 tending to respond at least somewhat differently to the same input electrical signal or the same input pressure wave, the cMUT variation exhibiting more movement of the collapsed region of the flexible membrane 106 will ordinarily be considered to be the more efficient device.

Despite efforts to date, a need remains for efficient and effective cMUT apparatus and methods of use thereof. These and other needs are satisfied by the disclosed apparatus, systems and methods, as will be apparent from the description which follows.

In accordance with embodiments of the present disclosure, a capacitive ultrasound transducer is provided, the transducer comprising a substrate and a flexible membrane, the flexible membrane including peripheral regions along which the flexible membrane is mounted to the substrate, and a middle region extending between the peripheral regions. The substrate of the transducer is contoured so that the flexible membrane is collapsed against the substrate in a vicinity of the middle region in the absence of a bias voltage, thereby permitting the transducer to be operated in collapse mode either with a reduced bias voltage, or with no bias voltage. A non-collapsible gap may exist between the substrate and the flexible membrane in a vicinity of each of the peripheral regions. The contour of the substrate may be such as to strain the flexible membrane past the point of collapse in the vicinity of the middle region, and/or to mechanically interfere with the flexible membrane to an extent of up to about 2 μm (e.g., to an extent of about 1.6 μm) in the vicinity of the middle region. The substrate may include a further membrane disposed beneath the flexible membrane, the further membrane being contoured so that the flexible membrane is collapsed against the further membrane in the vicinity of the middle region in the absence of a bias voltage. A length and thickness of the flexible membrane may be greater than about 80 μm (e.g., about 100 μm) and less than about 3 μm (e.g., about 2 μm), respectively, and the further membrane may be at least about 4 μm thick (e.g., about 5 μm thick). The substrate may further include a support disposed beneath the further membrane, the support being dimensioned and configured to deflect a corresponding portion of the further membrane upward toward the flexible membrane to an extent at least equal to the thickness of an original gap between the support and the flexible membrane. The support may be a post disposed beneath the further membrane and vertically aligned with the middle region of the flexible membrane, and/or may be structurally incomplete beneath regions of the further membrane other than a central portion thereof vertically aligned with the middle region of the flexible membrane. The support may operate to deflect a central portion of the further membrane vertically aligned with the middle region of the flexible membrane vertically upward to an extent of at least about 0.5 μm (e.g., to an extent of between about 0.9 μm and about 2.5 μm), while permitting at least one relatively peripheral portion of the further membrane to remain substantially vertically undeflected. The substrate may be contoured so that the flexible membrane is collapsed against the substrate in a vicinity of the middle region in the absence of a bias voltage, thereby permitting the transducer to be operated in collapse mode with an improved efficiency ($k^2_{eff}$) as compared to otherwise similar conventional transducers exhibiting comparably uncontoured substrates.

In accordance with embodiments of the present disclosure, a medical imaging system comprising a capacitive ultrasound transducer is provided, the transducer comprising a substrate and a flexible membrane, the flexible membrane including peripheral regions along which the flexible membrane is mounted to the substrate, and a middle region extending between the peripheral regions. The substrate of the transducer is contoured so that the flexible membrane is collapsed against the substrate in a vicinity of the middle region in the absence of a bias voltage, thereby permitting the transducer to be operated in collapse mode either with a reduced bias voltage, or with no bias voltage. The medical imaging system may comprise an array of such transducers disposed on a common substrate.

In accordance with embodiments of the present disclosure, a method of operating a capacitive ultrasound transducer is provided, the method including providing a transducer including a substrate and a flexible membrane, the flexible membrane including peripheral regions along which the flexible membrane is mounted to the substrate, and a middle region extending between the peripheral regions, wherein the substrate is contoured so that the flexible membrane is collapsed against the substrate in a vicinity of the middle region in the absence of a bias voltage; and operating the transducer in collapse mode in the absence of a bias voltage.

To assist those of skill in the art in making and using the disclosed apparatus, systems and methods, reference is made to the accompanying figures, wherein.

Figure 3:
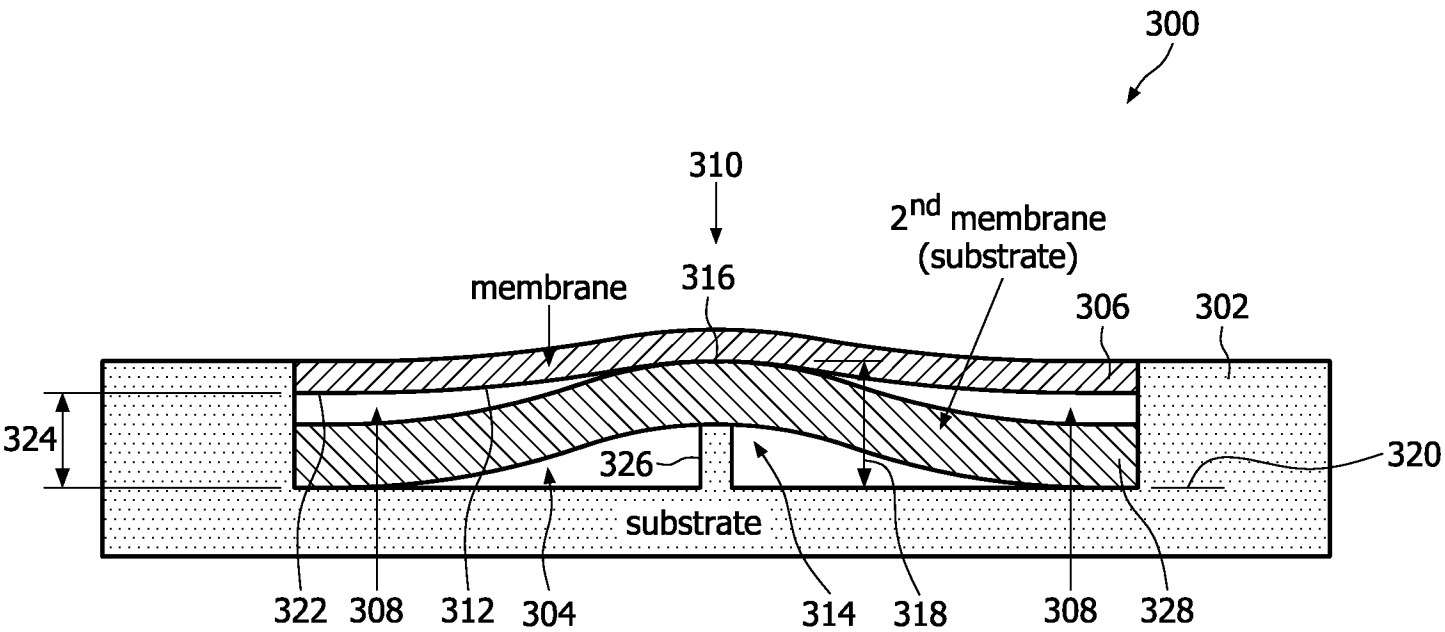
FIG. 3 illustrates a cMUT configured in accordance with embodiments of the present disclosure.
Figure 8:
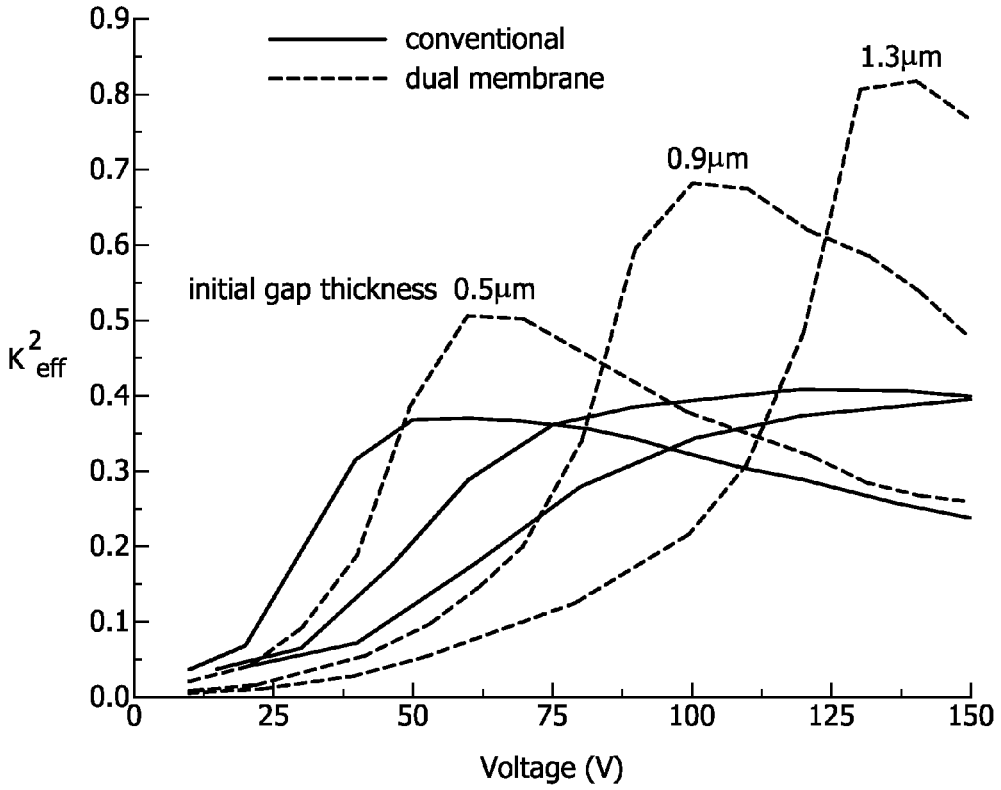
Figure 9:
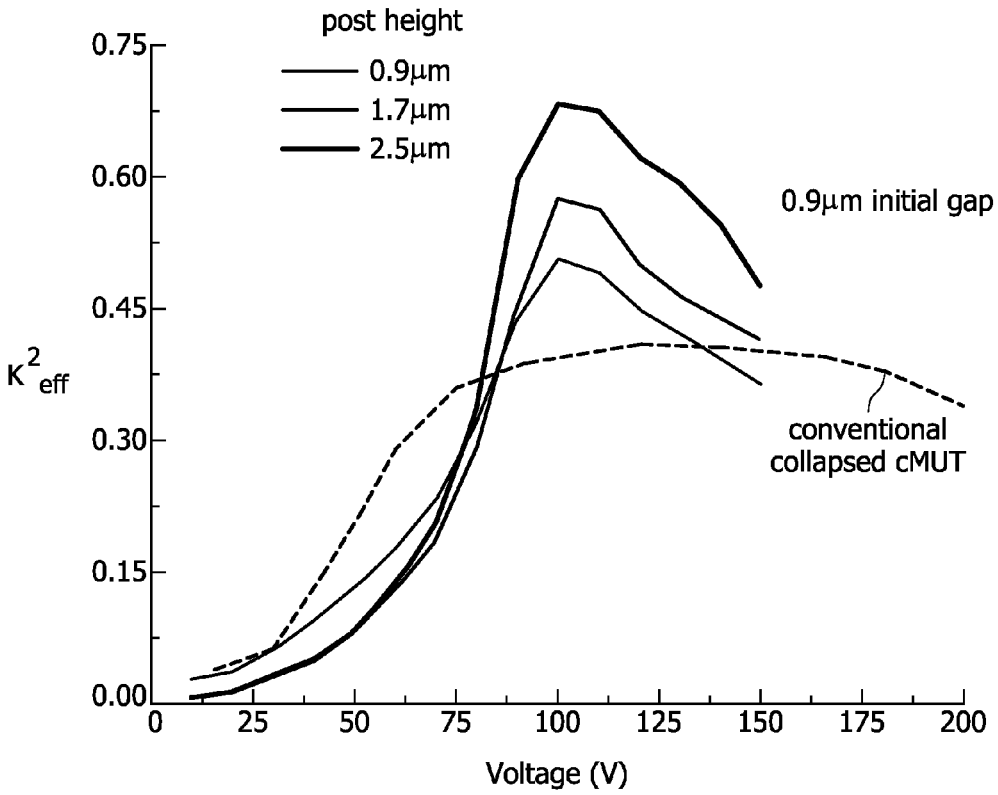
Figure 10:
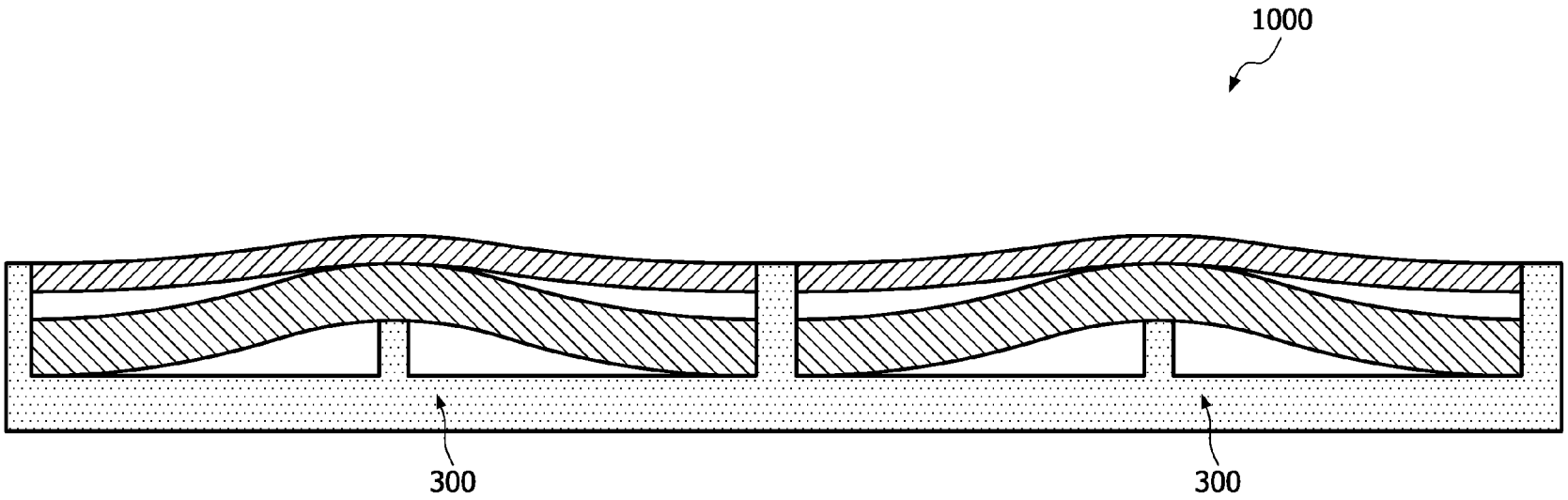

FIGS. 4, 5, 6, and 7 collectively depict a method of fabricating the cMUT of FIG. 3 in accordance with embodiments of the present disclosure;

FIGS. 8 and 9 set forth efficiency data corresponding to various embodiments of a cMUT in accordance with the present disclosure as compared to certain conventional but otherwise comparable cMUTs as a function of bias voltage; and FIG. 10 illustrates a system for generating medical diagnostic images in accordance with embodiments of the present disclosure, the system including an array of cMUT devices configured in accordance with the present disclosure.

One of the traditional disadvantages of using cMUTs in the collapse mode is that collapse voltages are typically much larger than the operating voltages and therefore high voltage circuitry is required. In addition, output power is usually a limiting factor for cMUTs in imaging applications, such that any improvement in efficiency of such devices is desirable.

The present applicants have found, through modelling and simulation, that implementing certain alterations to the substrate surface of the cMUT can result in an improvement of the efficiency in collapse mode operation. The substrate, which in some embodiments of the present disclosure includes a second membrane, may be contoured so that the middle of the flexible membrane of the cMUT has no gap (collapse mode without bias). This allows cMUTs in accordance with the present disclosure to be operated in collapse mode with no (or a small) bias voltage. Moreover, the applicants have found that cMUTs in accordance with the present disclosure exhibit an increase in efficiency when the substrate was used to strain the membrane past the point of contact (collapse). In addition to the efficiency improvement, cMUTs in accordance with the present disclosure allow for a significant reduction in the required voltages. Among other associated advantages, such improvements render cMUTs in accordance with the present disclosure relatively more suitable for introduction into mainstream ultrasound probes.

Turning now to FIG. 3, a cMUT device is shown in accordance with exemplary embodiments of the present disclosure. More particularly, FIG. 3 shows a cMUT 300 in schematic cross section. The cMUT 300 includes a substrate 302 in which a pocket 304 is formed. The cMUT 300 further includes a flexible membrane 306 coupled to the substrate 302 across the pocket 304. The flexible membrane 306 may include respective peripheral regions 308 along which the flexible membrane 306 may be mounted to the substrate 302 around or about a corresponding periphery of the pocket 304. The flexible membrane 306 may further include a middle region 310 extending between the peripheral regions 308. Still further, the flexible membrane 306 may define a downward-facing surface 312. The substrate 302 may further include a structure 314 disposed within the periphery of the pocket 304. The structure 314 may define and/or at least structurally support an upward-facing contoured surface 316. The upward-facing contoured surface 316 may extend or protrude upward and/or outward of the pocket 304 for contacting and/or otherwise cooperatively engaging the downward-facing surface 312 of the flexible membrane 306 in a vicinity of the middle region 310. The contoured surface 316 may be at least one or more of arcuate, curved, convex, and dome-shaped. Other shapes for the contoured surface 316 are possible. The contoured surface 316 may define or include a sufficiently small or short lateral and/or depthwise (e.g., along a direction oriented normal to the paper of FIG. 3) extent such that the contoured surface is substantially entirely contained or confined within the pocket 304. For example, the contoured surface 316 may be dimensioned and configured so as to comprise or define a substantially isolated 'island' within the pocket 304 for interacting exclusively with the middle region 310 of flexible membrane 306 (e.g., wherein the contoured surface either defines a correspondingly reduced profile in, or is substantially absent from, a vicinity of the peripheral regions 308). Other geometric and/or dimensional configurations for the lateral and/or depthwise extent of the contoured surface 316 are possible.

In accordance with embodiments of the present disclosure, and as particularly shown in FIG. 3, at least a portion or segment of the contoured surface 316 may occupy an elevation 318 relative to a reference elevation 320 of the substrate 302, and at least a portion or segment of a downward-facing surface 322 associated with one or more of the peripheral regions 308 of the flexible membrane 306 may occupy an elevation 324 relative to the same reference elevation 320, the elevation 318 being to at least some extent higher relative to the reference elevation 320 than the elevation 324. For example, a basic elevation for the flexible membrane 306 relative to the substrate 302 may be established via all of the peripheral regions 308 thereof occupying a common elevation in elevation 324, such that in the absence of any interaction between the contoured surface 318 and the flexible membrane 306, the entire extent of the downward-facing surface 312 of the flexible membrane 306 would tend to be substantially horizontally aligned with and positioned at the elevation 324. In such circumstances, the occupation by at least a portion or segment of the contoured surface 316 of the substrate 302 of the elevation 320 at least some extent higher than the basic elevation 324 of the flexible membrane 306 may produce a mechanical interference between the contoured surface 316 and downward facing surface 312 of the flexible membrane 306. In turn, the flexible membrane 306 may be deflected upward by the contoured surface 316 and/or by the structure 314, creating a pre-load that may cause the contoured surface 316 to remain in constant contact with the flexible membrane 306 in a vicinity of the middle region 310.

In accordance with the present disclosure, the particular nature, configuration, or placement of electrodes associated with the cMUT 300, not separately shown or indicated in FIG. 3, are not necessarily critical. As such, any type or manner of improvement or optimization of electrode configurations generally applicable to cMUTs may be applied to the cMUT 300 in particular.

As shown in FIG. 3, the structure 314 included as part of the cMUT 300 may include a post 326 disposed substantially in a center of the pocket 304 and extending upward therein in a direction of the flexible membrane 306, and a lower membrane 328 disposed within and extending across the pocket 304, including over and across the post 326. As indicated above, and explained further herein, the structure 314 and the contoured surface 316 associated therewith puts the cMUT 300 in a collapsed mode in the equilibrium position (e.g., zero (0) volt bias voltage). The lower membrane 328 may be significantly thicker and/or stiffer than the flexible membrane 306 to minimize energy lost into the substrate 302 (movement of the lower membrane 328 doesn't necessarily result in an emitted pressure wave). In accordance with embodiments of the present disclosure, the length and thickness of the flexible membrane 306 may be approximately 100 μm and approximately 2 μm respectively, and the lower membrane 328 may be approximately 5 μm thick. The height of the top of the post 326 may be set to a dimension corresponding to an initial gap thickness (e.g., undeformed membranes) plus approximately 1.6 μm. Other dimensions and/or related combinations of dimensions for the length and thickness of the flexible membrane 306, the thickness of the lower membrane 328, and the height of the top of the post 326 are possible, and may be used to achieve a similar enhancing effect in accordance with embodiments of the present disclosure.

Figure 4:
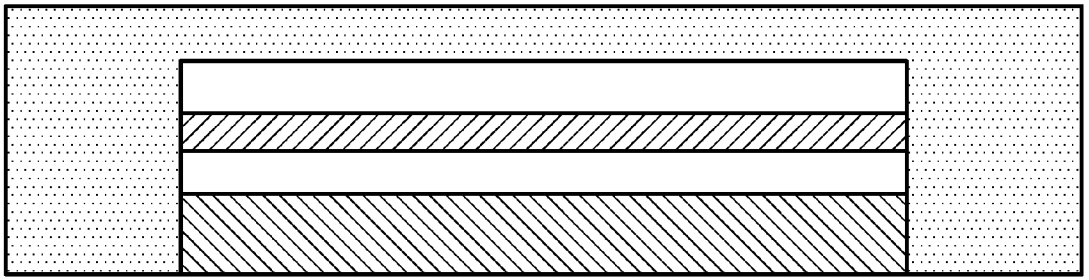
Figure 5:
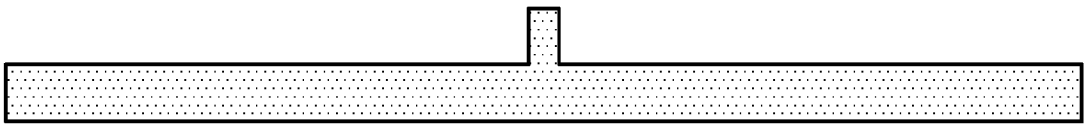
Figure 6:
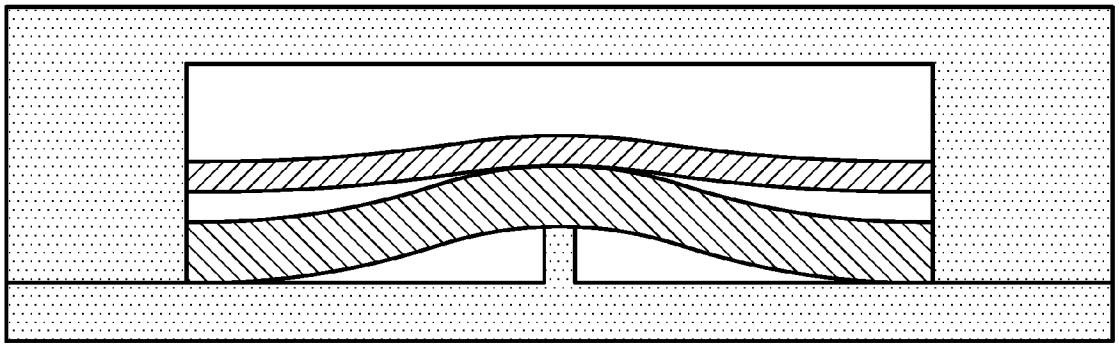
Figure 7:
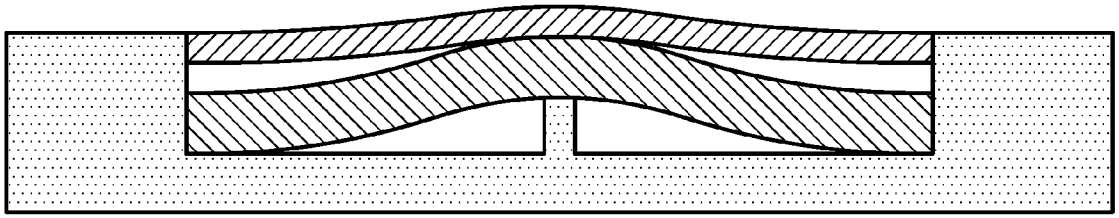

Further in accordance with exemplary embodiments of the present disclosure, the cMUT 300 may be fabricated using one or more of a variety of processes and manufacturing techniques. For example, and as illustrated in FIGS. 4, 5, 6 and 7, one such method of fabricating the cMUT 300 will now be discussed. An SOI wafer may be used to produce a substrate that has a dual membrane structure as shown in FIG. 4. Another wafer may be used to produce the substrate with a post structure as shown in FIG. 5. The two wafers may be aligned and bonded together to produce the structure in FIG. 6. The substrate of the dual membrane structure may be removed to give the final structure as shown in FIG. 7.

Figure 1:
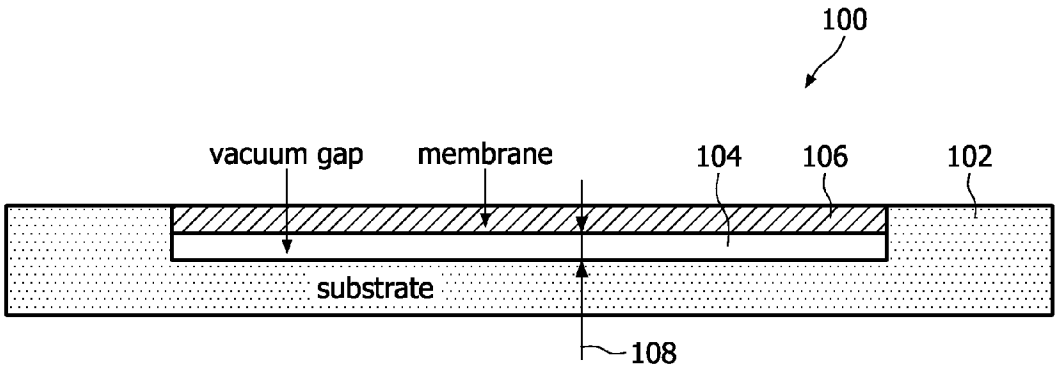
FIG. 1 illustrates a prior art cMUT.
Figure 2:
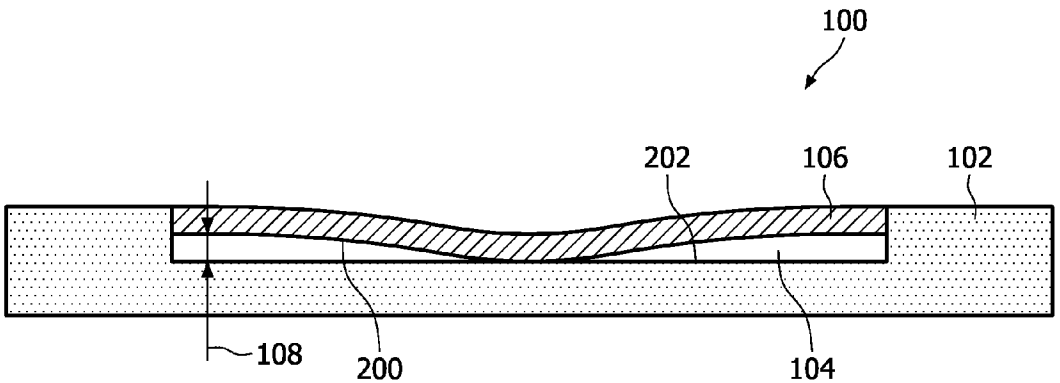
FIG. 2 illustrates the cMUT of FIG. 1 in a collapsed mode of operation.

The present applicants performed modelling and simulation to compare the efficiency ($k^2_{eff}$) of the cMUT 300 shown and described above with respect to FIG. 3 to that of the conventional collapsed cMUT 100 shown in FIG. 2. FIG. 8 shows this comparison as a function of initial gap thickness ranging from 0.5 to 1.3 μm (in these cases the post height was the initial gap thickness plus 1.6 μm). The cMUT 300 shows a significant increase in the efficiency for all the gap thicknesses and can be twice as large for bigger gaps. The present applicants further explored the variation of post height from initial gap thickness to initial gap thickness plus 1.6 μm as shown in FIG. 9 (the initial gap thickness was 0.9 μm). The post height of 0.9 μm (initial gap thickness) raises the lower membrane 328 just to the contact point with the flexible membrane 306 and shows a slight increase in efficiency (over a small voltage range) for the dual membrane structure and this increases as the post height increases.

The dual membrane structure is one way of realizing cMUTs with an improved efficiency in accordance with the present disclosure. Any process that results in a substrate shape like the dual membrane structure should also possess a higher efficiency. The improved efficiency should be realized in both transmit and receive functions (reciprocal) of the cMUT 300.

Applications well suited for devices such as the cMUT 300 include large arrays for medical ultrasound systems. In accordance with exemplary embodiments of the present disclosure, such medical ultrasound systems may include one or more systems such as the system 1000 illustrated in FIG. 10. The system 1000 includes an array of cMUT devices in accordance with the present disclosure, including but not necessarily limited to the two cMUTs 300 shown. Such cMUT devices, including the cMUTs 300 specifically shown, may be grouped in an array, such as a large 2D array, providing the system 1000 with enhanced functionality and performance characteristics consistent with the present disclosure. A large form factor may be achievable insofar as the cMUTs 300 may be fabricated using conventional silicon processes. In addition, in accordance with embodiments of the present disclosure, drive electronics may be integrated with the transducers of the system 1000.

The disclosed apparatus, systems and methods are susceptible to many further variations and alternative applications, without departing from the spirit or scope of the present disclosure.

The invention claimed is:

1. A capacitive ultrasound transducer, comprising:

a substrate; and a flexible membrane, the flexible membrane including peripheral regions along which the flexible membrane is mounted to the substrate, and a middle region extending between the peripheral regions;

wherein the substrate is contoured so that the flexible membrane is collapsed against the substrate in a vicinity of the middle region in the absence of a bias voltage, thereby permitting the transducer to be operated in collapse mode either with a reduced bias voltage, or with no bias voltage, wherein the substrate further includes a further membrane disposed beneath the flexible membrane, the further membrane being contoured so that the flexible membrane is collapsed against the further membrane in the vicinity of the middle region in the absence of a bias voltage, and wherein the substrate further includes a support disposed beneath the further membrane, the support being dimensioned and configured to deflect a corresponding portion of the further membrane upward toward the flexible membrane to an extent at least equal to the thickness of an original gap therebetween.

2. A capacitive ultrasound transducer in accordance with claim 1, wherein a non-collapsible gap exists between the substrate and the flexible membrane in a vicinity of the peripheral regions.

3. A capacitive ultrasound transducer in accordance with claim 1, wherein the substrate is contoured to strain the flexible membrane past the point of collapse in the vicinity of the middle region.

4. A capacitive ultrasound transducer in accordance with claim 1, wherein the substrate is contoured to mechanically interfere with the flexible membrane to an extent of up to about 2 μm in the vicinity of the middle region.

5. A capacitive ultrasound transducer in accordance with claim 1, wherein the substrate is contoured to mechanically interfere with the flexible membrane to an extent of about 1.6 μm in the vicinity of the middle region.

6. A capacitive ultrasound transducer in accordance with claim 1, wherein a length and thickness of the flexible membrane is greater than about 80 μm and less than about 3 μm, respectively, and the further membrane is at least about 4 μm thick.

7. A capacitive ultrasound transducer in accordance with claim 1, wherein a length and thickness of the membrane is about 100 μm and about 2 μm, respectively, and the further membrane is about 5 μm thick.

8. A capacitive ultrasound transducer in accordance with claim 1, wherein the support is a post disposed beneath the further membrane and vertically aligned with the middle region of the flexible membrane.

9. A capacitive ultrasound transducer in accordance with claim 1, wherein the support is structurally incomplete beneath regions of the further membrane other than a central portion thereof vertically aligned with the middle region of the flexible membrane.

10. A capacitive ultrasound transducer in accordance with claim 1, wherein the support operates to deflect a central portion of the further membrane vertically aligned with the middle region of the flexible membrane vertically upward to an extent of at least about 0.5 μm, while permitting at least one relatively peripheral portion of the further membrane to remain substantially vertically undeflected.

11. A capacitive ultrasound transducer in accordance with claim 10, wherein the support operates to deflect the central portion of the further membrane vertically upward to an extent of between about 0.9 μm and about 2.5 μm.

12. A capacitive ultrasound transducer in accordance with claim 1, wherein the substrate is contoured so that the flexible membrane is collapsed against the substrate in a vicinity of the middle region in the absence of a bias voltage, thereby permitting the transducer to be operated in collapse mode with an improved efficiency ($k^2_{eff}$) as compared to otherwise similar conventional transducers exhibiting comparably uncontoured substrates.

13. A medical imaging system comprising a capacitive ultrasound transducer in accordance with claim 1.

14. A medical imaging system comprising an array of capacitive ultrasound transducers in accordance with claim 1 disposed on a common substrate.

15. A method of operating a capacitive ultrasound transducer, comprising:

providing a transducer including a substrate and a flexible membrane, the flexible membrane including peripheral regions along which the flexible membrane is mounted to the substrate, and a middle region extending between the peripheral regions, wherein the substrate is contoured so that the flexible membrane is collapsed against the substrate in a vicinity of the middle region in the absence of a bias voltage; and operating the transducer in collapse mode in the absence of a bias voltage, wherein the substrate further includes a support disposed beneath a further membrane, the support being dimensioned and configured to deflect a corresponding portion of the further membrane upward toward the flexible membrane to an extent at least equal to the thickness of an original gap therebetween.

16. A method in accordance with claim 15, wherein the support includes a post disposed beneath the further membrane and vertically aligned with the middle region of the flexible membrane.

17. A method in accordance with claim 16, wherein the support is structurally incomplete beneath regions of the further membrane other than a central portion thereof vertically aligned with the middle region of the flexible membrane.

* * * * *